US010877390B2

(12) United States Patent
Shimano et al.

(10) Patent No.: US 10,877,390 B2
(45) Date of Patent: Dec. 29, 2020

(54) TONER

(71) Applicant: CANON KABUSHIKI KAISHA, Tokyo (JP)

(72) Inventors: Tsutomu Shimano, Mishima (JP); Reo Tagawa, Tokyo (JP); Taku Shimoda, Machida (JP); Yoshihiro Nakagawa, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/525,993

(22) Filed: Jul. 30, 2019

(65) Prior Publication Data

US 2020/0041922 A1 Feb. 6, 2020

(30) Foreign Application Priority Data

Aug. 2, 2018 (JP) ..... 2018-146131
Feb. 25, 2019 (JP) ..... 2019-031467

(51) Int. Cl.
*G03G 9/093* (2006.01)
*G03G 9/087* (2006.01)
*G03G 9/08* (2006.01)

(52) U.S. Cl.
CPC ..... *G03G 9/09378* (2013.01); *G03G 9/0821* (2013.01); *G03G 9/08711* (2013.01);
(Continued)

(58) Field of Classification Search
CPC ..... G03G 9/08711; G03G 9/08755; G03G 9/08797; G03G 9/0821; G03G 9/0825;
(Continued)

(56) References Cited

U.S. PATENT DOCUMENTS 4,960,669 A 10/1990 Mori et al.
6,569,589 B2 5/2003 Inaba et al.
(Continued)

FOREIGN PATENT DOCUMENTS

JP 2006-267516 10/2006
JP 2012-063574 3/2012
(Continued)

OTHER PUBLICATIONS

English language machine translation of JP 2014-35506. (Year: 2014).*
(Continued)

*Primary Examiner* — Christopher D Rodee
(74) *Attorney, Agent, or Firm* — Venable LLP

(57) ABSTRACT

Toner, including: a toner particle that contains a binder resin and a wax, wherein the binder resin includes an amorphous resin A, and, in dynamic viscoelasticity measurement of the toner, when the temperature at which the loss elastic modulus G" measured at a frequency of 1 Hz becomes $1.00\times10^6$ Pa is set as T(1 Hz), when the temperature at which the loss elastic modulus G" measured at a frequency of 20 Hz becomes $1.00\times10^6$ Pa is set as T(20 Hz), and when the maximum value of the ratio (tan δ) of the loss elastic modulus G" with respect to the storage elastic modulus G', measured at a frequency of 20 Hz, in a range of from 60° C. to 90° C. is set as tan δ(P), the toner satisfies T(20 Hz)−T(1 Hz)≤7.0° C., 0.80≤tan δ(P)≤1.90, 60° C.≤T(1 Hz)≤80° C., and 60° C.≤T(20 Hz)≤80° C.

5 Claims, 4 Drawing Sheets

(52) U.S. Cl.
CPC ..... *G03G 9/08797* (2013.01); *G03G 9/09328* (2013.01); *G03G 9/09364* (2013.01)

(58) Field of Classification Search
CPC ..... G03G 9/08782; G03G 9/08795; G03G 9/09328; G03G 9/09364; G03G 9/09378
See application file for complete search history.

(56) References Cited

U.S. PATENT DOCUMENTS

| | | | | |
|---|---|---|---|---|
| 7,582,402 | B2 | 9/2009 | Yamazaki et al. | |
| 8,603,712 | B2 | 12/2013 | Aoki et al. | |
| 8,741,519 | B2 | 6/2014 | Watanabe et al. | |
| 8,846,284 | B2 | 9/2014 | Kinumatsu et al. | |
| 9,158,216 | B2 | 10/2015 | Shimano et al. | |
| 9,170,509 | B2 | 10/2015 | Masuda | |
| 9,377,705 | B2 | 6/2016 | Shimano et al. | |
| 9,383,668 | B2 | 7/2016 | Noji et al. | |
| 9,429,860 | B2 | 8/2016 | Kinumatsu et al. | |
| 9,500,972 | B2 | 11/2016 | Tanaka et al. | |
| 9,551,947 | B2 | 1/2017 | Hiroko et al. | |
| 9,575,424 | B2 | 2/2017 | Nakagawa et al. | |
| 9,599,919 | B2 | 3/2017 | Isono et al. | |
| 9,658,549 | B2 | 5/2017 | Tanaka et al. | |
| 9,785,071 | B2 * | 10/2017 | Shimano ..... | G03G 9/09328 |
| 9,829,816 | B2 | 11/2017 | Tanaka et al. | |
| 9,835,964 | B2 | 12/2017 | Yoshida et al. | |
| 9,880,478 | B2 | 1/2018 | Shimano et al. | |
| 9,904,193 | B2 | 2/2018 | Nakagawa et al. | |
| 9,921,501 | B2 | 3/2018 | Mochizuki et al. | |
| 9,952,523 | B2 | 4/2018 | Shimano et al. | |
| 9,958,801 | B2 | 5/2018 | Tanaka et al. | |
| 10,078,279 | B2 | 9/2018 | Nakagawa et al. | |
| 10,101,681 | B2 | 10/2018 | Tagawa et al. | |
| 10,114,303 | B2 | 10/2018 | Katsura et al. | |
| 10,303,074 | B2 | 5/2019 | Yamawaki et al. | |
| 10,416,582 | B2 | 9/2019 | Nakagawa et al. | |
| 10,429,757 | B2 | 10/2019 | Yoshida et al. | |
| 10,437,165 | B2 | 10/2019 | Shimano et al. | |
| 2015/0248071 | A1 * | 9/2015 | Katsura ..... | G03G 9/08755 430/109.3 |
| 2017/0160663 | A1 * | 6/2017 | Arimura ..... | G03G 9/0926 |
| 2018/0329332 | A1 | 11/2018 | Tominaga et al. | |
| 2019/0235406 | A1 | 8/2019 | Yamawaki et al. | |

FOREIGN PATENT DOCUMENTS

| | | | |
|---|---|---|---|
| JP | 2014035506 A | * | 2/2014 |
| JP | 6020458 | | 10/2016 |
| JP | 2017-040772 | | 2/2017 |
| JP | 2017-044952 | | 3/2017 |

OTHER PUBLICATIONS

U.S. Appl. No. 16/438,545, Kenta Kamikura, filed Jun. 12, 2019.
U.S. Appl. No. 16/438,553, Kenji Aoki, filed Jun. 12, 2019.
U.S. Appl. No. 16/438,566, Takashi Matsui, filed Jun. 12, 2019.

* cited by examiner

TONER

BACKGROUND OF THE INVENTION

Field of the Invention

The present invention relates to a toner used for developing an electrostatic latent image formed by a method such as an electrophotographic method, an electrostatic recording method, and a toner jet recording method and forming a toner image.

Description of the Related Art

In recent years, further reduction of power consumption of printers and copying machines has been demanded. In order to respond to this demand, a toner that melts rapidly at a lower temperature, that is, that has excellent low-temperature fixability is preferable. In order to obtain a toner having excellent low-temperature fixability, use of a wax for a toner have been examined.

A wax is added in order to plasticize a binder resin. When a wax melted by heating is compatible with the binder resin, the viscosity in a toner-molten state is lowered and excellent low-temperature fixability is thus obtained. Based on such findings, toners including an ester wax have been proposed in Japanese Patent Application Publication No. 2017-040772, Japanese Patent Application Publication No. 2017-044952, Japanese Patent No. 6020458, Japanese Patent Application Publication No. 2012-63574 and Japanese Patent Application Publication No. 2006-267516.

SUMMARY OF THE INVENTION

Meanwhile, if the viscosity when a toner melts is lowered, the toner tends to attach to a fixing member (separability is lowered) during fixing. As a result, a problem of paper being wound around the fixing member easily occurs. In addition, when separability of the toner is lowered, a part of an image may attach to the fixing member, and as a result, a missing part called a dot is easily generated. Therefore, low-temperature fixability may also decrease.

In addition, toners are required to have excellent low-temperature fixability, and heat-resistant storability in a balanced manner. However, a wax added in order to plasticize a binder resin tends to have high compatibility with the binder resin and a low melting point. Therefore, during storage under a high temperature environment, a part of the wax contained in the toner may melt and may be exuded on the surface of a toner particle, and storability may deteriorate.

Therefore, toners using a wax are further required to have low-temperature fixability, separability, and heat-resistant storability in a balanced manner.

In toners described in Japanese Patent Application Publication No. 2017-040772 and Japanese Patent Application Publication No. 2017-044952, an ester wax is used to improve low-temperature fixability. However, in consideration of whether the compatibility between an ester wax and a binder resin is sufficiently improved, these are not sufficient. In addition, it is found that, due to the influence of a coat layer used for improvement in developing performance, low-temperature fixability according to the ester wax may not be sufficiently exhibited and there is room for improvement.

In the toner described in Japanese Patent No. 6020458, an ester wax having high compatibility is used, but it is not sufficient in consideration of appropriately controlling the melt viscosity of the toner to obtain favorable separability. Specifically, although a crosslinkable polymerizable monomer is added in order to also achieve hot-offset resistance, low-temperature fixability may deteriorate due to its influence. In addition, it is found that, in the design of the coat layer used for improvement of storability, the compatibility between the coat layer and the ester wax is not considered and thus there is room for improvement in separability.

In addition, in toners described in Japanese Patent Application Publication No. 2012-63574 and Japanese Patent Application Publication No. 2006-267516, an ester wax having high compatibility is used. However, in consideration of whether a high melting point of the ester wax is maintained and heat-resistant storability is favorable, these are not sufficient.

The present invention provides a toner that addresses the above problems.

That is, the present invention provides a toner in which low-temperature fixability and separability, and heat-resistant storability are all achieved.

The present invention provides a toner, including a toner particle that contains a binder resin and a wax, wherein the binder resin includes an amorphous resin A, and, in dynamic viscoelasticity measurement of the toner, when the temperature at which the loss elastic modulus G" measured at a frequency of 1 Hz becomes $1.00\times10^6$ Pa is set as T(1 Hz), when the temperature at which the loss elastic modulus G" measured at a frequency of 20 Hz becomes $1.00\times10^6$ Pa is set as T(20 Hz), and when the maximum value of the ratio (tan δ) of the loss elastic modulus G" with respect to the storage elastic modulus G', measured at a frequency of 20 Hz, in a range of from 60° C. to 90° C. is set as tan δ(P), the toner satisfies the following Formulae (1) to (4):

$$T(20\text{ Hz})-T(1\text{ Hz})\leq 7.0^\circ\text{ C.} \quad \text{Formula (1)}$$

$$0.80\leq \tan\delta(P)\leq 1.90 \quad \text{Formula (2)}$$

$$60^\circ\text{ C.}\leq T(1\text{ Hz})\leq 80^\circ\text{ C.} \quad \text{Formula (3)}$$

$$60^\circ\text{ C.}\leq T(20\text{ Hz})\leq 80^\circ\text{ C.} \quad \text{Formula (4)}$$

According to the present invention, it is possible to provide a toner in which low-temperature fixability and separability, and heat-resistant storability are all achieved.

Further features of the present invention will become apparent from the following description of exemplary embodiments with reference to the attached drawings.

DESCRIPTION OF THE EMBODIMENTS

In the present invention, the statement "from XX to YY" and "XX to YY" indicating a numerical range refer to a numerical range including the lower limit and the upper limit which are end points unless otherwise noted.

Ease of deformation of a toner can be represented as an elastic modulus. An elastic modulus is a numerical value of a force required to deform a material such as a toner by a certain amount. For example, when an elastic modulus at a storage temperature is high, the deformation is unlikely to occur. Thus, a toner with such an elastic modulus is considered to have an excellent storability. Meanwhile, when an elastic modulus in a toner-molten state is low, the melt viscosity of the toner during fixing is lower. Thus, a toner with such an elastic modulus is considered to have an excellent fixability.

Figure 1:
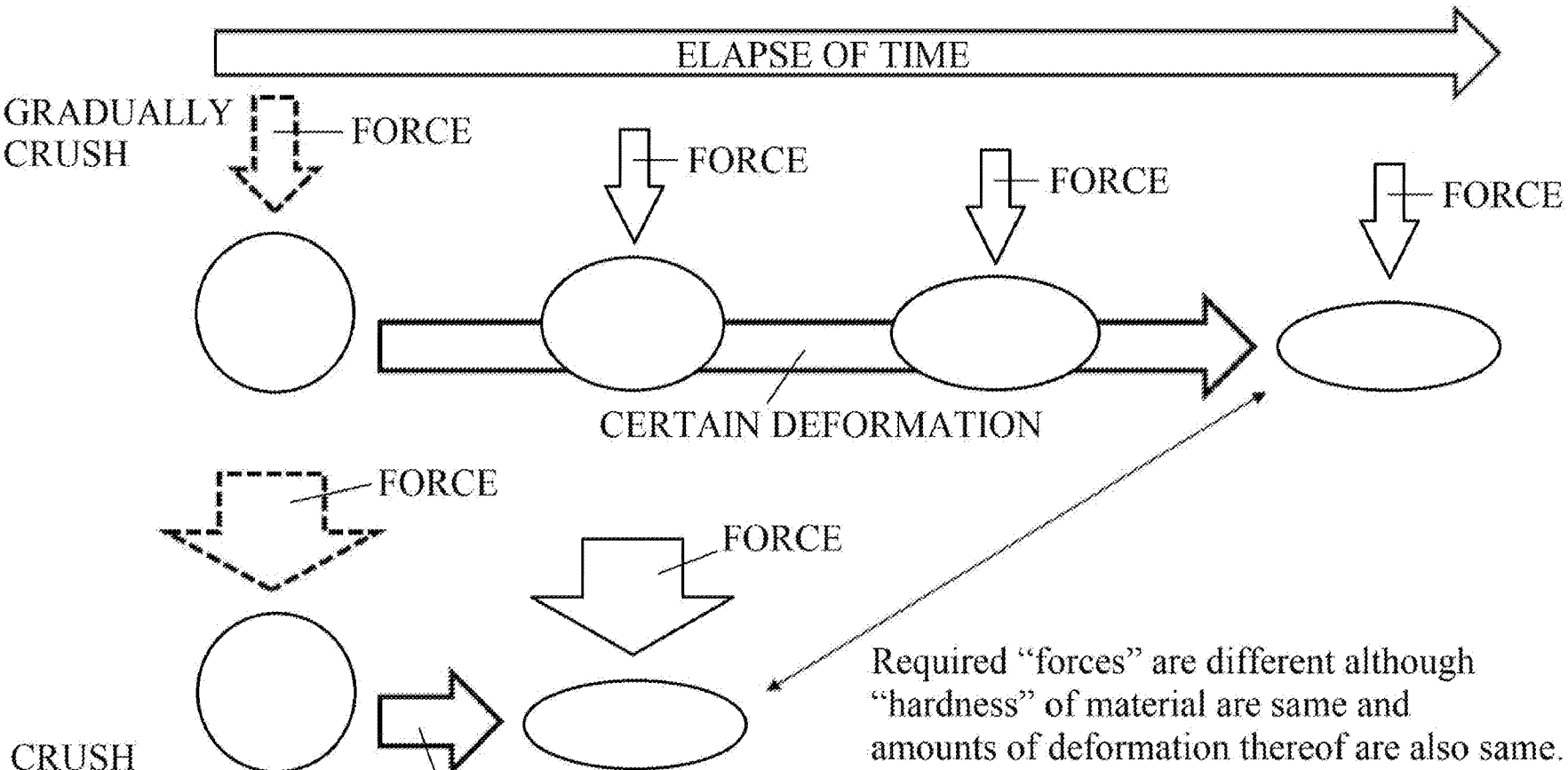
FIG. 1 is a schematic view illustrating a deformation velocity and a magnitude of a force required for deformation.

A deformation velocity is one of measurement parameters of the elastic modulus. This means a velocity at which a toner is deformed when an elastic modulus is measured, and is set as a frequency when a dynamic viscoelasticity measuring apparatus is used. For example, a strong force is necessary to quickly deform a toner by a certain amount. However, even with the same amount of deformation, if low deformation velocity is acceptable, deformation will be possible with a weak force (FIG. 1).

Figure 2:
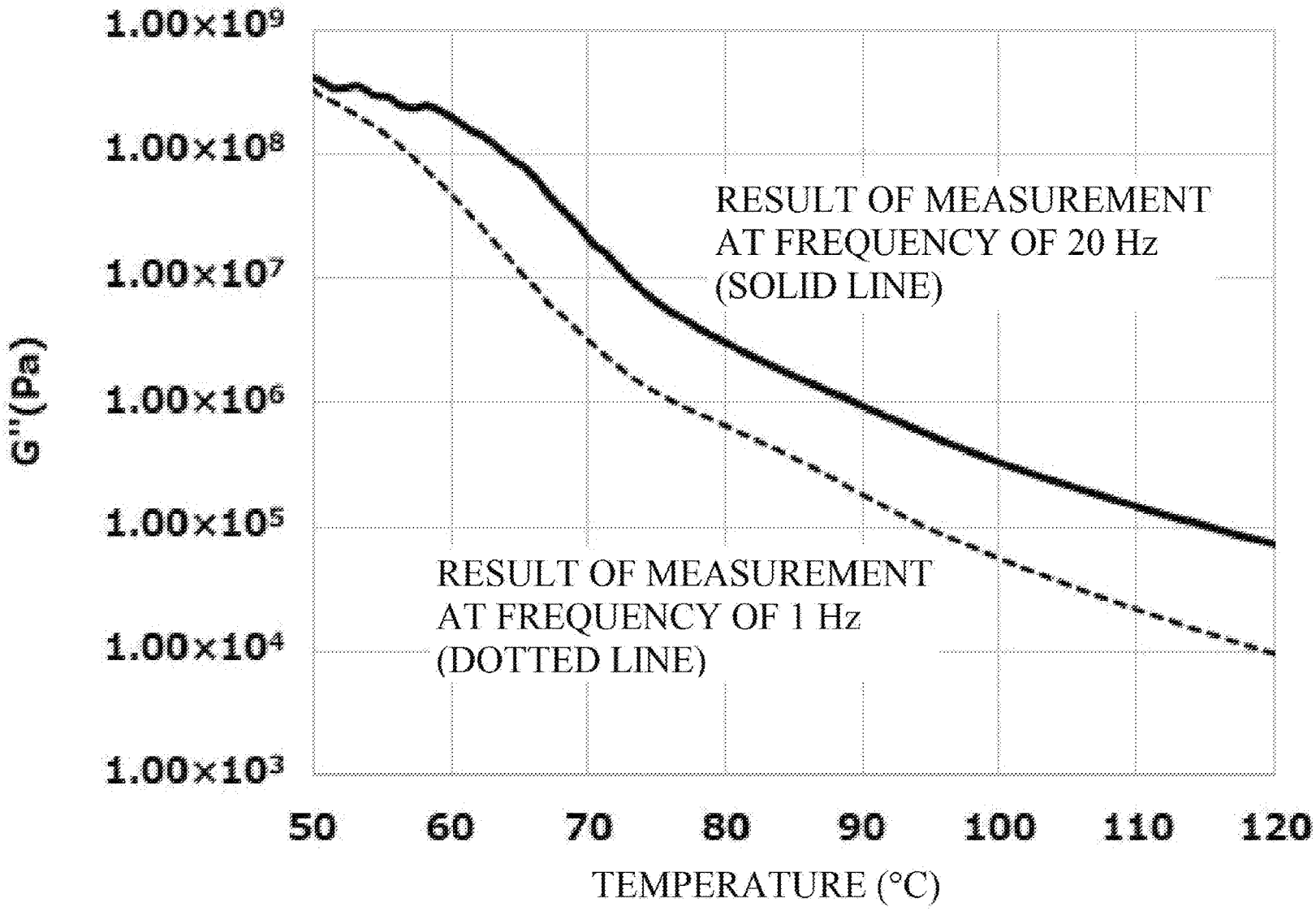
FIG. 2 is a diagram showing results of measurement of an elastic modulus of a toner of the conventional art measured at frequencies of 1 Hz and 20 Hz.

Actually, FIG. 2 shows an example in which measurement is performed while changing a frequency in dynamic viscoelasticity measurement of a toner. FIG. 2 reveals that, compared to measurement under low frequency conditions, in measurement under high frequency conditions, a higher elastic modulus is obtained even in the same measurement temperature.

Now an actual case where the above deformation velocity is applied to a toner is assumed. When the toner is stored such as during long-term storage or storage at high temperatures, a force is gradually applied to the toner. Therefore, it is presumable that heat-resistant storability of the toner has a high correlation with the elastic modulus measured in low frequency conditions. In contrast, a pressure is instantaneously applied to the toner in a fixing process. Therefore, it is presumable that low-temperature fixability of the toner has a high correlation with the elastic modulus measured in high frequency conditions.

As a result of repeating examinations based on the above presumptions, it is found that both heat-resistant storability and low-temperature fixability can be achieved in a balanced manner when the value of the elastic modulus measured in low frequency conditions is higher and the value of the elastic modulus measured in high frequency conditions is lower.

That is, in dynamic viscoelasticity measurement of the toner, when the temperature at which the loss elastic modulus G" measured at a frequency of 1 Hz becomes $1.00\times10^6$ Pa is set as T(1 Hz) and the temperature at which the loss elastic modulus G" measured at a frequency of 20 Hz becomes $1.00\times10^6$ Pa is set as T(20 Hz), it is necessary to satisfy the following Formula (1).

$$T(20\text{ Hz})-T(1\text{ Hz})\leq 7.0^\circ\text{ C.} \qquad \text{Formula (1)}$$

Here, a measured value at a frequency of 1 Hz is an elastic modulus in low frequency conditions and is believed to be a value corresponding to heat-resistant storability. A measured value at a frequency of 20 Hz is an elastic modulus in high frequency conditions and is thought to be a value corresponding to fixability.

Specifically, a time for which a toner is pressurized in the fixing process is assumed to be about 50 ms, which corresponds to 20 Hz when converted into a frequency. Satisfying Formula (1) means that a difference between the elastic modulus at a frequency of 1 Hz and the elastic modulus at a frequency of 20 Hz is sufficiently small, and heat-resistant storability and low-temperature fixability can be achieved at a high level in a balanced manner.

A value of $1.00\times10^6$ Pa is a numerical value assuming an elastic modulus at which the toner can be fixed.

Figure 3:
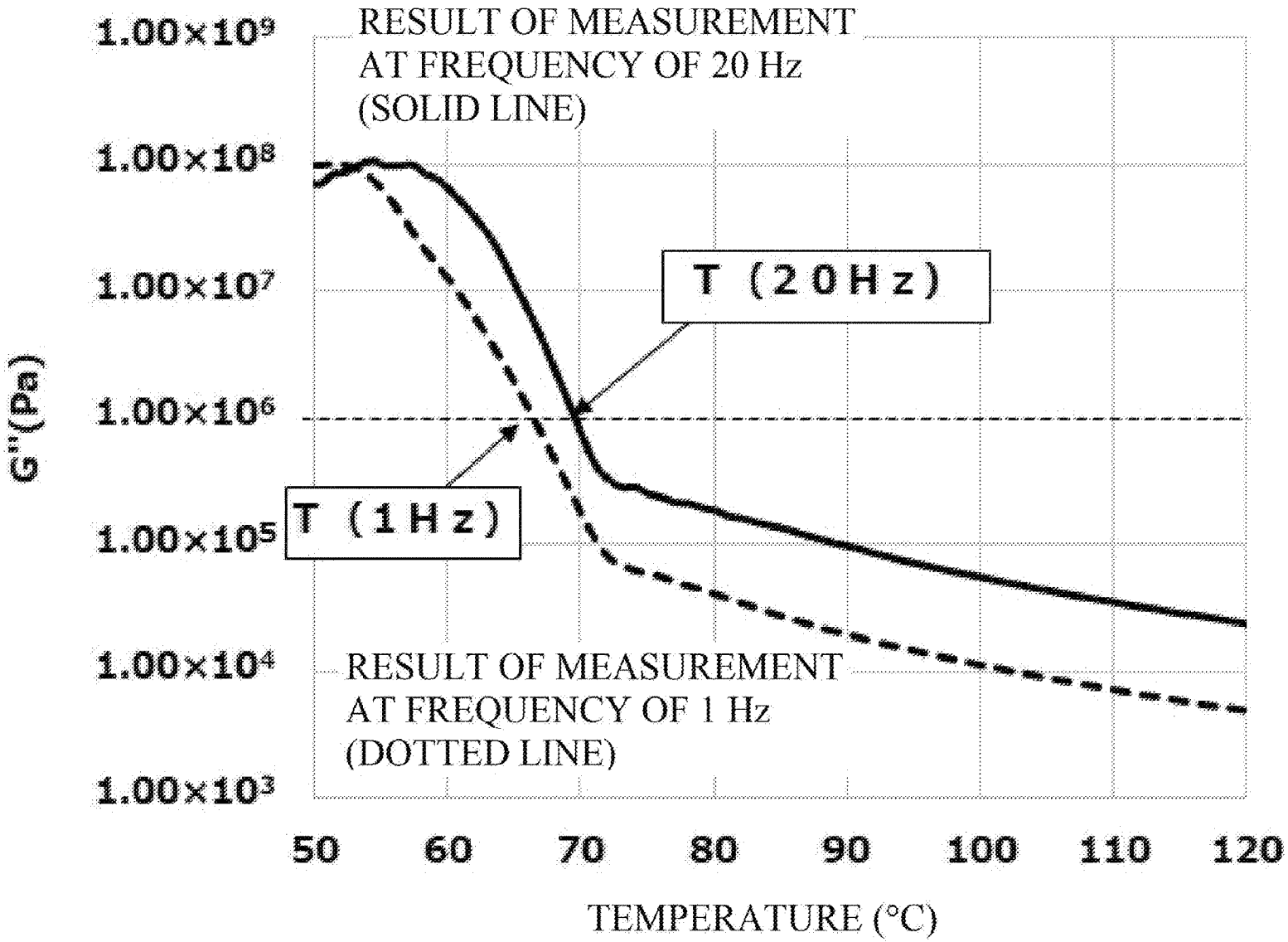
FIG. 3 is a diagram showing results of measurements of an elastic modulus of a toner of the present invention measured at frequencies of 1 Hz and 20 Hz.

FIG. 3 shows an example of results of measurement of the elastic modulus of the toner of the present invention. Values of T(20 Hz)−T(1 Hz) is small. Thus, when a value of T(1 Hz) is increased so as to increase heat-resistant storability, the value of T(20 Hz) does not easily increase, and excellent low-temperature fixability can be obtained.

Generally, an amorphous resin used for a toner has a high dependence with respect to the frequency on the elastic modulus. This is because such an amorphous resin softens since entanglement of molecules is gradually loosened by heating. Meanwhile, when the frequency is higher, an entanglement interaction of molecules is stronger, and the elastic modulus is thus higher (example shown in FIG. 2).

Figure 4:
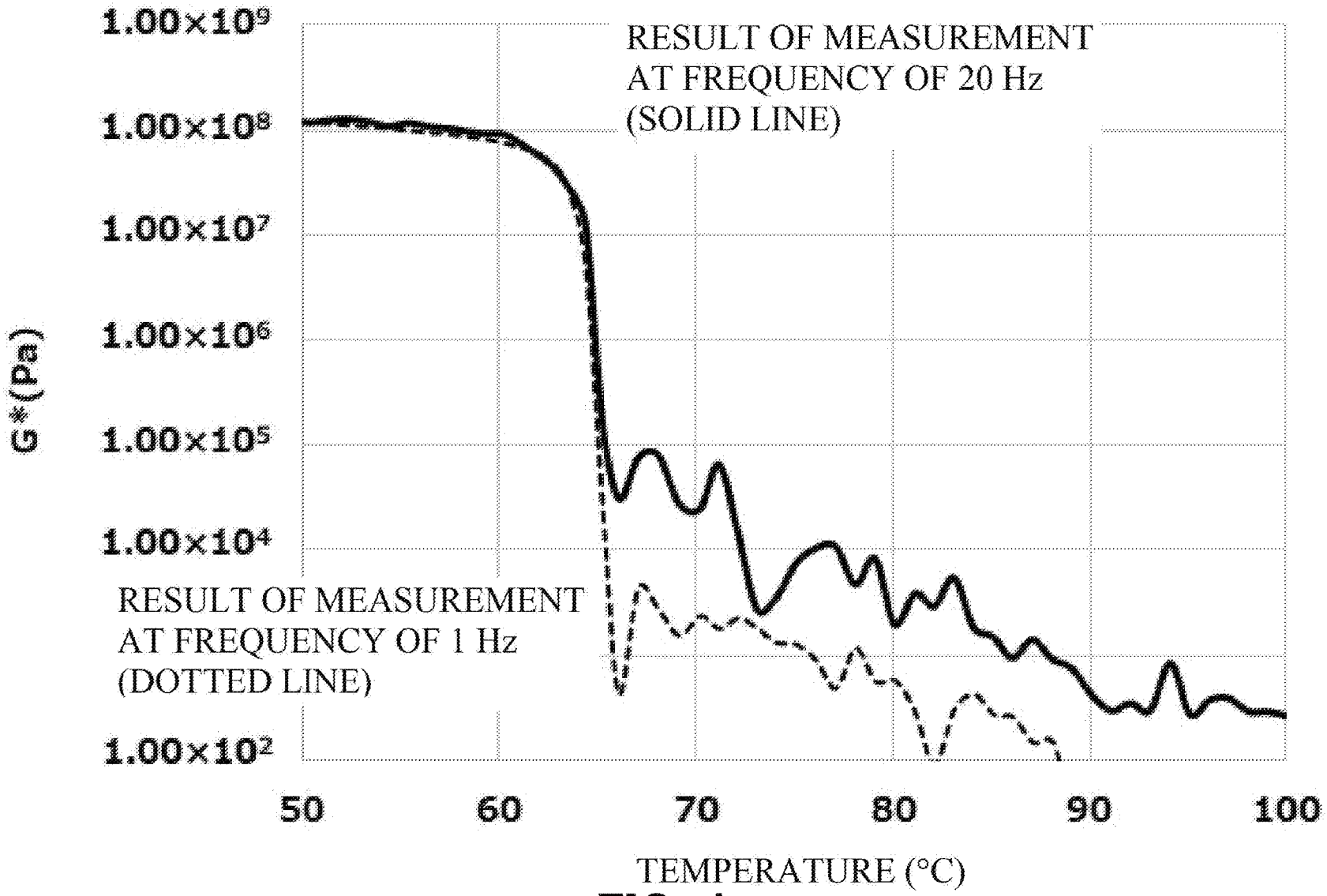
FIG. 4 is a diagram showing results of measurements of an elastic modulus of a wax alone measured at frequencies of 1 Hz and 20 Hz.

On the contrary, a crystalline material such as a wax has low dependency with respect to the frequency on the elastic modulus. When a crystalline material is heated to a temperature equal to or higher than a melting point, crystals collapse and melt. In this case, melting occurs regardless of entanglement of molecules. Thus, even if the frequency is changed, the temperature at which the elastic modulus decreases does not change (FIG. 4). Therefore, a characteristic of low frequency dependence can be obtained by imparting a characteristic to the toner wherein viscosity decrease with melting of a wax.

Therefore, it is preferable to use a plasticizing effect of a wax for controlling a value of T(20 Hz)−T(1 Hz). When the compatibility of the wax with respect to a binder resin is higher, a plasticizing effect becomes strong and the elastic modulus of the toner can be greatly lowered. Thus, a value of T(20 Hz)−T(1 Hz) can be made smaller. When the molecular weight of the wax is smaller, an effect of reducing the elastic modulus of the toner becomes strong and a value of T(20 Hz)−T(1 Hz) can be made smaller.

A value of T(20 Hz)−T(1 Hz) is preferably 4.5° C. or lower. The lower limit is not particularly limited and is preferably −1.0° C. or higher, and more preferably 0° C. or higher.

If only the above characteristic is satisfied, an attachment force between the toner and the fixing member becomes stronger. Thus, separability may become lowered and problems of paper being wound around the fixing member tend to occur. Thus, when the maximum value of the ratio (G"/G')(tan δ) of the loss elastic modulus G" with respect to the storage elastic modulus G', measured at a frequency of 20 Hz, in a range of from 60° C. to 90° C. is set as tan δ(P), it is necessary to satisfy the following Formula (2).

$$0.80\leq\tan\delta(P)\leq 1.90 \qquad \text{Formula (2)}$$

When the value of tan δ(P) is smaller, since the value of the storage elastic modulus with respect to the loss elastic modulus is higher, a force restoring the deformed toner to its original state becomes larger. As a result, since a force separating the toner from the fixing member becomes larger, separability is improved. Therefore, the value of tan δ(P) is 1.90 or less. On the contrary, when tan δ(P) is smaller than 0.80, the toner does not deform sufficiently, and low-temperature fixability thus decreases.

It is preferable that tan δ(P) satisfy the following Formula (2').

$$1.00\leq\tan\delta(P)\leq 1.90 \qquad \text{Formula (2')}$$

It is also preferable that tan δ(P) satisfy the following Formula (2").

$$1.00 \leq \tan \delta(P) \leq 1.70 \quad \text{Formula (2")}$$

The reason why the tan δ when measurement is performed at a frequency of 20 Hz is used is that winding and separation are phenomenons during fixing. Since it is assumed that the toner is heated to from about 60° C. to about 90° C. during fixing, the above tan δ(P) is used.

A value of tan δ(P) can be controlled according to a molecular weight, a glass transition temperature Tg, a degree of crosslinking, an encapsulation (coat layer), and the like of the toner. In order to achieve both low-temperature fixability and heat-resistant storability, achievement is preferably performed by controlling the coat layer.

In addition, the following Formulae (3) and (4) are satisfied with respect to the toner of the present invention.

$$60° \text{ C.} \leq T(1 \text{ Hz}) \leq 80° \text{ C.} \quad \text{Formula (3)}$$

$$60° \text{ C.} \leq T(20 \text{ Hz}) \leq 80° \text{ C.} \quad \text{Formula (4)}$$

When T(1 Hz) and T(20 Hz) are lower than 60° C., heat-resistant storability decreases. In addition, when T(1 Hz) and T(20 Hz) are higher than 80° C., excellent low-temperature fixability is not obtained. It is preferable to satisfy the following Formulae (3') and (4').

$$60° \text{ C.} \leq T(1 \text{ Hz}) \leq 70° \text{ C.} \quad \text{Formula (3')}$$

$$60° \text{ C.} \leq T(20 \text{ Hz}) \leq 75° \text{ C.} \quad \text{Formula (4')}$$

Regarding a method of controlling values of T(1 Hz) and T(20 Hz), the values can be controlled using a molecular weight of the toner, Tg of the toner, an amount of a wax added, a melting point of a wax, and the like. Controlling the values on the basis of a melting point of a wax is simple and preferable.

As described above, when Formulae (1) to (4) are satisfied, it is possible to achieve both excellent low-temperature fixability and heat-resistant storability in a balanced manner, and reduction in separability which tends to occur in a toner with a low viscosity during melting can also be achieved at a high level.

Here, methods of measuring T(1 Hz), T(20 Hz) and tan δ(P) will be described below.

It is preferable for a toner particle to have a coat layer on the surface thereof. When the coat layer is provided, excellent separability is obtained even with a higher value of tan δ(P). As a result, both low-temperature fixability and separability can be easily achieved in a balanced manner.

When separability is desired to be improved using the coat layer, low compatibility between a material constituting the coat layer and the wax is preferable. Low compatibility can bring excellent separability without plasticizing the coat layer by the wax during fixing. Meanwhile, in such a design, the coat layer is in a hard state during fixing, and covers the binder resin. Thus, low-temperature fixability may decrease.

However, in the present invention, a wax having high compatibility with the toner particle is used so as to lower a value of T(20 Hz)−T(1 Hz) of the toner particle, and then a coat layer having low compatibility with the wax in the toner particle with a small value of T(20 Hz)−T(1 Hz). With this configuration, both low-temperature fixability and separability can be achieved in a balanced manner. The reason for this is speculated to be as follows.

A small value of T(20 Hz)−T(1 Hz) for a toner particle means that the elastic modulus of the toner is sufficiently reduced even if a pressure is instantaneously applied to the toner during fixing. It is assumed that, as a result, a binder resin can be quickly exuded from slight cracks (gaps) in the coat layer on the surface of a toner particle, which is caused by deformation of the toner during fixing, and thus, even if a coat layer having low compatibility with a wax is formed, low-temperature fixability becomes favorable.

In addition, when the compatibility between the wax and the coat layer is lower, low-temperature fixability and separability tend to be better. Accordingly, it is assumed that lower compatibility between the wax and the coat layer brings weaker interaction between the wax and the binder resin having high compatibility, which allows the binder resin to be rapidly exuded.

As described above, by using a coat layer having low compatibility with a wax for a toner particle with a small value of T(20 Hz)−T(1 Hz) both low-temperature fixability and separability are more easily achieved in a balanced manner.

In addition, the thickness of the coat layer is preferably from 10 nm to 200 nm. Within this range, it is easy to control a value of tan δ(P) to be within a desired range. A coat layer having a thickness of 10 nm or more can provide better separability and a coat layer having a thickness of 200 nm or less can provide excellent low-temperature fixability. The thickness of the coat layer is more preferably from 15 nm to 100 nm.

It is simple and preferable to control the thickness of the coat layer according to an amount of a material used for the coat layer.

Methods of determining whether there is a coat layer and of measuring the thickness thereof will be described below.

The coat layer preferably contains an amorphous resin B, and a glass transition temperature Tg of the amorphous resin B is preferably from 60° C. to 90° C. and more preferably from 60° C. to 85° C.

At 60° C. or higher, a high elastic modulus is obtained also at the storage temperature and the fixation temperature of the toner, and therefore better heat-resistant storability and separability are obtained. At 90° C. or lower, the coat layer softens in the same temperature range as the melting temperature of the toner particle, and thus the elastic modulus at the fixation temperature of the toner can be reduced and better low-temperature fixability is obtained.

The glass transition temperature of the amorphous resin B can be controlled according to a composition of monomers constituting the amorphous resin B.

A method of measuring a glass transition temperature of the amorphous resin B will be described below.

A resin that can be used as the amorphous resin B is not particularly limited, and a resin used for a conventional toner can be used. Examples thereof may include a polyester resin; a styrene acrylic resin; a polyamide resin; a furan resin; an epoxy resin; a xylene resin; and a silicone resin.

The amorphous resin B preferably contains a polyester resin and is more preferably a polyester resin. Since a polyester resin has high polarity, the compatibility with a wax tends to be lowered. Therefore, the coat layer is unlikely to be plasticized due to the wax, and it is possible to control tan δ(P) and reduce exudation of the wax during storage of the toner. As a result, better separability and heat-resistant storability are obtained.

The weight average molecular weight of the amorphous resin B is preferably 5,000 to 30,000.

Regarding the polyester resin, a known polyester resin can be used.

The polyester resin can be obtained, for example, by dehydration condensation of a divalent acid or derivatives thereof (carboxylic acid halide, ester, acid anhydride) and a divalent alcohol, and additionally, as necessary, a trivalent or higher polyvalent acid and derivatives thereof (carboxylic acid halide, ester, acid anhydride), a monovalent acid, a trivalent or higher alcohol, a monovalent alcohol, or the like.

Examples of the divalent acid include aliphatic divalent acids such as maleic acid, fumaric acid, itaconic acid, oxalic acid, malonic acid, succinic acid, dodecylsuccinic acid, dodecenylsuccinic acid, adipic acid, azelaic acid, sebacic acid, and decane-1,10-dicarboxylic acid; aromatic divalent acids such as phthalic acid, tetrahydrophthalic acid, hexahydrophthalic acid, tetrabromophthalic acid, tetrachlorophthalic acid, Het acid, himic acid, isophthalic acid, terephthalic acid, and 2,6-naphthalene dicarboxylic acid; and alicyclic divalent acids such as 1,4-cyclohexanedicarboxylic acid, 1,3-cyclohexanedicarboxylic acid, 1,2-cyclohexanedicarboxylic acid, 4-methyl-1,2-cyclohexanedicarboxylic acid, cis-4-cyclohexene-1,2-dicarboxylic acid, cis-1-cyclohexene-1,2-dicarboxylic acid, norbornane dicarboxylic acid, norbornene dicarboxylic acid, and 1,3-adamantane dicarboxylic acid.

Divalent acids preferably include an aromatic divalent acid. In addition, examples of divalent acid derivatives include carboxylic acid halides, esterified products and acid anhydrides of aliphatic divalent acids, aromatic divalent acids, and alicyclic divalent acids.

Meanwhile, examples of the divalent alcohol include aliphatic diols such as ethylene glycol, 1,2-propylene glycol, 1,4-butanediol, 1,5-pentanediol, 1,6-hexanediol, diethylene glycol, dipropylene glycol, triethylene glycol, and neopentyl glycol; bisphenols such as bisphenol A and bisphenol F; bisphenol A alkylene oxide adducts such as a bisphenol A ethylene oxide adduct and a bisphenol A propylene oxide adduct; aralkylene glycols such as xylylene glycol; and alicyclic diols such as 1,4-cyclohexanedimethanol, isosorbide, spiroglycol, hydrogenated bisphenol A, 1,4-cyclohexanediol, 1,2-cyclohexanediol, 1,3-cyclohexanediol, 4-(2-hydroxyethyl)cyclohexanol, 4-(hydroxymethyl)cyclohexanol, 4,4'-bicyclohexanol, and 1,3-adamantanediol.

Divalent alcohols preferably include a bisphenol A alkylene oxide adduct.

Examples of a trivalent or higher polyvalent acid and anhydrides thereof may include trimellitic acid, trimellitic anhydride, 1,3,5-cyclohexanetricarboxylic acid, 1,2,4-cyclohexanetricarboxylic acid, 1,2,4,5-cyclohexanetetracarboxylic acid, 1,2,3,4,5,6-cyclohexanehexacarboxylic acid, methylcyclohexenetricarboxylic acid, methylcyclohexenetricarboxylic acid anhydride, pyromellitic acid, and pyromellitic anhydride.

Among these materials, preferable one is a polyester resin having a structure derived from at least one selected from the group consisting of ethylene glycol, oxalic acid and oxalic acid derivatives (that is, at least one of a structure represented by —O—$CH_2$—$CH_2$—O— and a structure represented by —C(=O)—C(=O)—). More preferably, the polyester resin has a structure derived from ethylene glycol (that is, a structure represented by —O—$CH_2$—$CH_2$—O—).

Having such a structure, polyester resin includes an increased number of ester groups, and thus has high polarity. Therefore, the compatibility of the polyester resin with a wax is lowered, and tan δ(P) thereof can be designed in a preferable range. As a result, favorable separability and excellent low-temperature fixability are obtained.

A total content of a structure derived from at least one selected from the group consisting of ethylene glycol, oxalic acid, and oxalic acid derivatives in the polyester resin is preferably, in mol % based on all monomer units of the polyester resin, from 2.0 mol % to 15.0 mol %.

In addition, the polyester resin preferably has a structure derived from isosorbide (that is, a structure represented by the following Formula (A)). The structure derived from isosorbide has high polarity because it has oxygen in its molecular structure, and a polyester resin having low compatibility with a wax is obtained. In addition, isosorbide has a cyclic structure. Thus, when the wax is an aliphatic ester wax, a polyester resin having lower compatibility with a wax is obtained. As a result, better separability and excellent low-temperature fixability are obtained.

A content of a structure derived from isosorbide in a polyester resin is preferably, in mol % based on all monomer units of the polyester resin, from 2.5 mol % to 30.0 mol %.

(A)

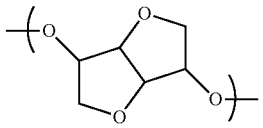

The binder resin contains an amorphous resin A. The amorphous resin A is preferably a resin having a styrene acrylic polymer segment (more preferably, a styrene acrylic polymer, and still more preferably a styrene acrylic copolymer) and a content of a resin having a styrene acrylic polymer segment in the binder resin is preferably 50 mass % or more. The content of a resin is more preferably 80 mass % or more. The upper limit is not particularly limited and the content of a resin is preferably 100 mass % or less.

This means that the binder resin preferably contains a styrene acrylic resin as a main component. The styrene acrylic resin has high compatibility with a wax because it does not have high polarity, and enables to effectively use a wax plasticizing effect. Therefore, it is easy to control a value of T(20 Hz)−T(1 Hz) described above, and both low-temperature fixability and heat-resistant storability can be achieved in a balanced manner.

In the binder resin, in addition to the amorphous resin A, a resin used for a conventional toner may be used in combination.

Examples of the binder resin may include a polyester resin; a styrene acrylic resin; a polyamide resin; a furan resin; an epoxy resin; a xylene resin; and a silicone resin.

Examples of a polymerizable monomer capable of forming a styrene acrylic polymer segment may include the following.

Examples thereof may include styrene monomers such as styrene, α-methylstyrene, and divinylbenzene; unsaturated carboxylic acid esters such as methyl acrylate, butyl acrylate, methyl methacrylate, 2-hydroxyethyl methacrylate, t-butyl methacrylate, and 2-ethylhexyl methacrylate; unsaturated carboxylic acids such as acrylic acid and methacrylic acid; unsaturated dicarboxylic acids such as maleic acid; unsaturated dicarboxylic anhydrides such as maleic anhydride; nitrile vinyl monomers such as acrylonitrile; halogen-containing vinyl monomers such as vinyl chloride; and nitrovinyl monomers such as nitrostyrene. These can be used alone or a plurality thereof can be used in combination.

The wax is not particularly limited, and known waxes used in toners as described below can be used.

Examples thereof may include esters of a monovalent alcohol and an aliphatic carboxylic acid or esters of a monovalent carboxylic acid and an aliphatic alcohol such as behenyl behenate, stearyl stearate, and palmityl palmitate; esters of a divalent alcohol and an aliphatic carboxylic acid or esters of a divalent carboxylic acid and an aliphatic alcohol such as dibehenyl sebacate, and hexanediol dibehenate; esters of a trivalent alcohol and an aliphatic carboxylic acid or esters of a trivalent carboxylic acid and an aliphatic alcohol such as glyceryl tribehenate; esters of a tetravalent alcohol and an aliphatic carboxylic acid or esters of a tetravalent carboxylic acid and an aliphatic alcohol such as pentaerythritol tetrastearate, and pentaerythritol tetrapalmitate; esters of a hexavalent alcohol and an aliphatic carboxylic acid or esters of a hexavalent carboxylic acid and an aliphatic alcohol such as dipentaerythritol hexastearate, and dipentaerythritol hexapalmitate; esters of a multivalent alcohol and an aliphatic carboxylic acid or esters of a polyvalent carboxylic acid and an aliphatic alcohol such as polyglycerin behenate; natural ester waxes such as carnauba wax and rice wax; petroleum waxes such as a paraffin wax, a microcrystalline wax, and petrolatum, and derivatives thereof; a hydrocarbon wax obtained by a Fischer-Tropsch process and derivatives thereof; polyolefin waxes such as a polyethylene wax and a polypropylene wax and derivatives thereof; higher aliphatic alcohols; fatty acids such as stearic acid and palmitic acid; and acid amide waxes.

These waxes may be used alone and a plurality of types thereof may be used.

Among these, a wax preferably contains an ester compound of a diol having 2 to 6 carbon atoms and an aliphatic monocarboxylic acid having 14 to 22 carbon atoms. Since this ester compound has particularly high compatibility with a styrene acrylic resin and a low molecular weight, an excellent plasticizing effect can be obtained. Therefore, a value of T(20 Hz)−T(1 Hz) can be reduced and both better low-temperature fixability and heat-resistant storability can be achieved.

In addition, due to a chemical structure having high linearity, the melting point and crystallinity are high, and better heat-resistant storability is obtained. In addition, an ester compound of a diol having 2 carbon atoms and an aliphatic monocarboxylic acid having 14 to 22 carbon atoms is more preferably included.

A melting point of the wax is preferably 60° C. to 90° C.

A content of the wax in the toner is preferably from 5.0 mass % to 20.0 mass %. Within this range, both low-temperature fixability and heat-resistant storability can be easily achieved. A range from 8.0 mass % to 15.0 mass % is more preferable. A method of measuring a content of the wax in the toner will be described below.

The toner particle may contain a colorant. Examples of the colorant include a black colorant, a yellow colorant, a magenta colorant, and a cyan colorant.

Examples of the black colorant include carbon black.

Examples of the yellow colorant include yellow pigments represented by a monoazo compound; a disazo compound; a condensed azo compound; an isoindolinone compound; an isoindoline compound; a benzimidazolone compound; an anthraquinone compound; an azo metal complex; a methine compound; and an allylamide compound. Specific examples thereof may include C.I. pigment yellow 74, 93, 95, 109, 111, 128, 155, 174, 180, and 185.

Examples of the magenta colorant include magenta pigments represented by a monoazo compound; a condensed azo compound; a diketopyrrolopyrrole compound; an anthraquinone compound; a quinacridone compound; a basic dye lake compound; a naphthol compound: a benzimidazolone compound; a thioindigo compound; and a perylene compound. Specific examples thereof may include C.I. pigment red 2, 3, 5, 6, 7, 23, 48:2, 48:3, 48:4, 57:1, 81:1, 122, 144, 146, 150, 166, 169, 177, 184, 185, 202, 206, 220, 221, 238, 254, 269, and C.I. pigment violet 19.

Examples of the cyan colorant include cyan pigments represented by copper phthalocyanine compounds and derivatives thereof, an anthraquinone compound; and a basic dye lake compound. Specific examples thereof may include C.I. pigment blue 1, 7, 15, 15:1, 15 2, 15:3, 15:4, 60, 62, 66.

In addition, together with pigments, various dyes conventionally known as colorants can be used.

A content of the colorant is preferably from 1.0 part to 20.0 parts with respect to 100 parts of a binder resin.

The toner particle may contain, as necessary, a known material such as a charge control agent, a charge control resin, and a pigment dispersing agent. In addition, a toner particle may contain, as necessary, a known material such as an organic silicon compound and a thermosetting resin, on the surface thereof.

In addition, a toner particle may be directly used as a toner, and as necessary, an external additive and the like may be mixed in and attached to the surface to prepare a toner.

Examples of the external additive include an inorganic fine particle selected from the group consisting of a silica fine particle, an alumina fine particle, and a titania fine particle or a complex oxide thereof. Examples of the complex oxide include silica aluminum fine particle and a strontium titanate fine particle.

An amount of the external additive added is preferably from 0.01 parts to 8.0 parts and more preferably from 0.1 parts to 4.0 parts with respect to 100 parts of a toner particle.

A weight average particle diameter (D4) of the toner is preferably from 4.0 μm to 9.0 μm. Within this range, the function regarding the thickness of the coat layer can be effectively exhibited, and thus, better separability can be obtained. The weight average particle diameter (D4) is more preferably from 4.0 μm to 8.0 μm. The weight average particle diameter (D4) of the toner can be controlled according to additives of the toner and production conditions. Here, a method of measuring a weight average particle diameter (D4) of the toner will be described below.

A weight average molecular weight Mw of the toner is preferably from 20,000 to 120,000. Within this range, both excellent low-temperature fixability and separability can be achieved in a balanced manner. The weight average molecular weight Mw is more preferably from 30,000 to 80,000. Here, a method of measuring a weight average molecular weight Mw of the toner will be described below.

The toner can be produced by a known method such as a pulverization method, a suspension polymerization method, an emulsion aggregation method, and a dissolution suspension method, and the production method is not particularly limited.

A method of measuring physical properties will be described below.

<Method of Measuring T(1 Hz), T(20 Hz), and tan δ(P) of Toner>

A rotating plate rheometer "ARES" (commercially available from TA Instruments) is used as a measuring apparatus.

Regarding a measurement sample, a sample, which is prepared by weighting out 0.1 g of a toner and pressure-molding the weighed toner using a tableting machine under a room temperature (25° C.) environment into a disk shape with a diameter of 8.0 mm and a thickness of 1.5±0.3 mm, is used.

The sample is placed on a parallel plate with a diameter of 8.0 mm, heated from room temperature (25° C.) to 120° C. for 5 minutes, and maintained for 3 minutes, and the sample is cooled to 50° C. for 10 minutes. Then, after holding the sample for 30 minutes, measurement starts. In this case, the sample is set so that an initial normal force be 0. As will be described below, in the subsequent measurement, the influence of the normal force can be cancelled out by turning the auto tension adjustment to be ON. Measurement is performed under the following conditions.

(1) A parallel plate with a diameter of 8.0 mm is used.
(2) Frequency: 1 Hz or 20 Hz
(3) An initial value of applied strain (Strain) is set to 0.2%.
(4) In a temperature range of from 50° C. to 120° C., measurement is performed at a temperature rising rate (Ramp Rate) of 2.0 [° C./min]. Here, measurement is performed in the following auto adjustment mode setting conditions. Measurement is performed in an auto strain adjustment mode (Auto Strain).
(5) A max applied strain is set to 20.0%.
(6) A max allowed torque is set to 200.0 [g·cm], and a min allowed torque is set to 0.2 [g·cm].
(7) Strain adjustment is set to 20.0% of a current strain. In measurement, an auto tension adjustment mode (Auto Tension) is used.
(8) An auto tension direction is set to compression.
(9) An initial static force is set to 10 g and an auto tension sensitivity is set to 10.0 g.
(10) Regarding an auto tension operating condition, a sample modulus is set to $1.00\times10^6$ Pa or more.

Under these conditions, the temperature at which the loss elastic modulus G" measured at a frequency of 1 Hz becomes $1.00\times10^6$ (Pa) is set as T(1 Hz), and the temperature at which the loss elastic modulus G" measured at a frequency of 20 Hz becomes $1.00\times10^6$ (Pa) is set as T(20 Hz).

In addition, the maximum value of the ratio (G"/G')(tan δ) of the loss elastic modulus G" with respect to the storage elastic modulus G', measured at a frequency of 20 Hz, in a range of from 60° C. to 90° C. is set as tan δ(P).

<Method of Measuring Glass Transition Temperature (Tg) of Toner and Amorphous Resin B>

The glass transition temperature (Tg) of the toner and the amorphous resin B is measured using a differential scanning calorimeter "Q1000" (commercially available from TA instruments). Melting points of indium and zinc are used for temperature correction of an apparatus detection unit, and a heat of fusion of indium is used for correction of a heat quantity.

Specifically, 1 mg of a sample is precisely weighed out and put into an aluminum pan. Another empty aluminum pan is used as a reference. Measurement is performed using a modulation measurement mode at a temperature rising rate of 1° C./min, under temperature modulation conditions of ±0.6° C./60 s in a range of from 0° C. to 100° C. Since a specific heat change is obtained in a heating procedure, an intersection point between a line at the intermediate point of base lines before and after the specific heat change appears and a differential heat curve is set as the glass transition temperature (Tg).

<Method of Measuring Content of Wax in Toner>

A content of the wax in the toner is measured using a differential scanning calorimeter "Q1000" (commercially available from TA instruments). Melting points of indium and zinc are used for temperature correction of an apparatus detection unit, and a heat of fusion of indium is used for correction of a heat quantity.

Specifically, an endothermic quantity of a wax alone is first measured.

1 mg of a wax (a wax in which, when a plurality types are used, they are mixed in proportions used for a toner) used for a toner is weighed out precisely and put into an aluminum pan. Another empty aluminum pan is used as a reference. Heating is performed at a temperature rising rate of 10° C./min from 0° C. to 150° C., and the temperature is maintained at 150° C. for 5 minutes. Then, cooling is performed at a cooling rate of 10° C./min from 150° C. to 0° C. Subsequently, the temperature is maintained at 0° C. for 5 minutes and heating is then performed at a temperature rising rate of 10° C./min from 0° C. to 150° C. The endothermic quantity ΔH1 (J/g) of the endothermic peak in the DSC curve in this case is set as an endothermic quantity of the wax alone.

Subsequently, the endothermic quantity of the toner is measured. 1 mg of a toner is weighed out precisely and put into an aluminum pan. Another empty aluminum pan is used as a reference. Heating is performed at a temperature rising rate of 10° C./min from 0° C. to 150° C., and the endothermic quantity ΔH2 (J/g) of the endothermic peak in the DSC curve in this case is set as an endothermic quantity of the toner.

Based on the endothermic quantity of the wax alone and the endothermic quantity of the toner measured in the above methods, a content of the wax in the toner is measured according to the following formula.

$$\text{Content of the wax in the toner (mass \%)} = \Delta H2/\Delta H1\times100$$

<Method of Determining whether there is a Coat Layer and Measuring Thickness of Coat Layer>

In a method of determining whether there is a coat layer and measuring a thickness of the coat layer, measurement is performed from a cross section image of a toner observed under a transmission electron microscope. The cross section of the toner observed under a transmission electron microscope is prepared as follows.

A procedure for preparing a cross section of toner stained with ruthenium will be described below.

First, toner is sprayed onto a cover glass (corner cover glass; square No. 1 commercially available from Matsunami Glass Ind., Ltd.) to form a single layer, an Os film (5 nm) and a naphthalene film (20 nm) are applied as protective films to the toner using an osmium plasma coater (OPC80T commercially available from Filgen).

Next, a photocurable resin D800 (commercially available from JEOL) is filled into a PTFE tube (Φ1.5 mm×Φ3 mm×3 mm), and the cover glass is gently placed on the tube in a direction in which the toner comes into contact with the photocurable resin D800. In this state, light is emitted to cure the resin, and the cover glass and the tube are then removed, thereby a cylindrical resin in which the toner is embedded on the outermost surface is formed.

Using an ultrasonic ultramicrotome (UC7 commercially available from Leica), at a cutting speed of 0.6 mm/s, a length from the outermost surface of the cylindrical resin to the radius of the toner (for example, 4.0 μm when the weight average particle diameter (D4) is 8.0 μm) is cut, and the cross section at the center of the toner is obtained.

Next, cutting is performed so that the film thickness is 100 nm and a thin section sample with a toner cross section is prepared. The cross section at the center of the toner can be obtained by performing cutting in such a method.

The obtained thin section sample is stained using a vacuum electron staining apparatus (VSC4R1H commercially available from Filgen), in an ruthenium tetraoxide ($RuO_4$) gas atmosphere of 500 Pa, for 15 minutes, and using a transmission electron microscope (TEM) (JEM2800 commercially available from JEOL), in conditions of an acceleration voltage of 200 kV, a TEM image of a toner is prepared.

A probe size of the TEM is 1 nm, and an image with an image size of 1024×1024 pixels is acquired.

The binder resin and the coat layer are observed with different contrasts in the TEM image of the toner. A difference between light and dark differs depending on the material. In the present invention, a part observed as a part having a different contrast from the binder resin is set as the coat layer. When the coat layer is in 80% or more of the length of the outline of the toner particle, it is determined that the toner particle has a coat layer.

Commercial image analysis software, WinROOF (commercially available from Mitani Corporation) is used to measure the thickness of the coat layer shown below.

In the TEM images of 10 toner particles selected at random, the thickness of the coat layer is measured at 4 points for each of the toner particles. Specifically, two straight lines directed to substantially the center of the toner cross section are drawn, and the thickness of the coat layer is measured at 4 points crossing the coat layer along the two straight lines. The thickness of the coat layer is a distance from the outline of the cross section of the toner to the interface between the binder resin and the coat layer. An average value of all measured values is set as the thickness of the coat layer of the toner.

<Method of Measuring Weight Average Molecular Weight (Mw)>

A weight average molecular weight (Mw) of a resin, a toner, or the like is measured through gel permeation chromatography (GPC) as follows.

First, a sample is dissolved in tetrahydrofuran (THF). Then, the obtained solution is filtered through a solvent-resistant membrane filter "Myshori Disk" with a pore diameter of 0.2 μm (commercially available from Tosoh Corporation) to obtain a sample solution. Here, the sample solution is adjusted so that a concentration of components soluble in THF is 0.8 mass %. Using such a sample solution, measurement is performed under the following conditions.

Apparatus: high-speed GPC apparatus "HLC-8220GPC" [commercially available from Tosoh Corporation]

Column: LF-604 2 columns [commercially available from Showa Denko K.K.]

Eluent: THF

Flow velocity: 0.6 ml/min

Oven temperature: 40° C.

Amount of a sample injected: 0.020 ml

In calculation of the molecular weight of the sample, a molecular weight calibration curve created using a standard polystyrene resin (for example, product name "TSK standard polystyrene F-850, F-450, F-288, F-128, F-80, F-40, F-20, F-10, F-4, F-2, F-1, A-5000, A-2500, A-1000, A-500", commercially available from Tosoh Corporation) is used.

<Method of Measuring Particle Size Distribution of Toner>

The particle size distribution of the toner is calculated as follows.

Regarding the measuring apparatus, an accurate particle size distribution measuring apparatus "Coulter counter Multisizer 3" (registered trademark product name, commercially available from Beckman Coulter Inc.) including an aperture tube of 100 μm and using a pore electrical resistance method is used. The setting of measurement conditions and the analysis of measurement data are performed using bundled dedicated software "Beckman Coulter Multisizer 3 Version 3.51" (commercially available from Beckman Coulter Inc.). Here, measurement is performed using 25,000 channels as effective measurement channels.

Regarding an aqueous electrolyte solution used for measurement, a solution in which a special grade sodium chloride is dissolved in deionized water so that the concentration is 1 mass %, for example, "ISOTON II" (commercially available from Beckman Coulter Inc.) can be used.

Here, dedicated software is set as follows before measurement and analysis are performed.

In the screen of "Change standard operation method (SOM)" in the dedicated software, the total count number in the control mode is set to 50,000 particles, the number of measurements is set to 1, and the Kd value is set as a value obtained using a "standard particle of 10.0 μm" (commercially available from Beckman Coulter Inc.). The threshold and the noise level are automatically set by pressing "measurement button of threshold/noise level." In addition, the current is set to 1,600 μA, the gain is set to 2, the electrolytic solution is set as ISOTON II, and "flush the aperture tube after measurement" is checked.

In the screen of "Settings of conversion from the pulse to the particle diameter" in the dedicated software, the bin interval is set to a logarithmic particle diameter, the particle diameter bin is set to a 256 particle diameter bin, and the particle diameter is set in a range of 2 μm to 60 μm.

A specific measurement method is as follows.

(1) 200 mL of an aqueous electrolyte solution is put into a 250 mL round bottom beaker made of glass (Multisizer 3 dedicated) and set on a sample stand, and stirring is performed counterclockwise using a stirrer rod at 24 revolutions/second. Then, according to the function of "flush aperture tube" in the dedicated software, dirt and air bubbles in the aperture tube are removed.

(2) 30 mL of an aqueous electrolyte solution is put into a 100 mL flat bottom beaker made of glass. 0.3 mL of a diluted solution in which "Contaminon N" (an aqueous solution containing 10 mass % of a neutral detergent for washing a precision measurement instrument with a pH of 7 containing a non-ionic surfactant, an anionic surfactant, and an organic builder, commercially available from Wako Pure Chemical Corporation) as a dispersing agent is diluted to 3 times by mass in deionized water is added thereto.

(3) An ultrasonic disperser "Ultrasonic Dispersion System Tetora 150" (commercially available from Nikkaki Bios Co., Ltd.) having two oscillators with an oscillation frequency of 50 kHz and with a phase shifted by 180 degrees built thereinto, and having an electrical output of 120 W is prepared. 3.3 L of deionized water is put into a water tank of the ultrasonic disperser and 2 mL of Contaminon N is added to the water tank.

(4) The beaker of the above (2) is set in a beaker fixing hole of the ultrasonic disperser and the ultrasonic disperser is activated. Then, the height position of the beaker is adjusted so that the resonance state of the liquid level of the aqueous electrolyte solution in the beaker is maximized.

(5) While ultrasound is emitted to the aqueous electrolyte solution in the beaker of the above (4), the toner is added to the aqueous electrolyte solution little by little so that there is 10 mg of toner which is dispersed. Then, additionally, the ultrasonic dispersion treatment continues for 60 seconds. Here, ultrasonic dispersion is appropriately adjusted so that the water temperature of the water tank is from 10° C. to 40° C.

(6) The aqueous electrolyte solution of the above (5) in which a toner is dispersed is added dropwise using a pipette into the round bottom beaker of the above (1) placed into the sample stand, and the measured concentration is adjusted to 5%. Then, measurement is performed until the number of particles measured is 50,000.
(7) Measurement data is analyzed using dedicated software bundled in the apparatus, and the weight average particle diameter (D4) and the number average particle diameter (D1) are calculated.

EXAMPLES

The present invention will be described below in detail with reference to examples. The present invention is, however, not limited to such examples. Here, "parts" in the examples is based on the mass unless otherwise noted.

Names and physical properties of waxes used in examples and comparative examples are shown in Table 1.

TABLE 1

| | Composition | Melting point Tm (° C.) | Molecular weight (calculated value) |
|---|---|---|---|
| Wax 1 | Ethylene glycol distearate | 75.8 | 595 |
| Wax 2 | Ethylene glycol dipalmitate | 69.4 | 539 |
| Wax 3 | Ethylene glycol dibehenate | 82.8 | 707 |
| Wax 4 | Hexanediol distearate | 63.4 | 651 |
| Wax 5 | Hexanediol dibehenate | 74.3 | 763 |
| Wax 6 | Dibehenyl sebacate | 73.4 | 819 |
| Wax 7 | Stearyl stearate | 61.8 | 537 |

Production Example of Polyester Resin 1

A reaction container including a stirrer, a thermometer, a nitrogen inlet tube, a dehydration tube, and a pressure reducing device was charged with monomers including 1.00 mol of terephthalic acid, 0.65 mol of bisphenol A propylene oxide (2 mol) adduct, and 0.35 mol of ethylene glycol and heating was performed to a temperature of 130° C. under stirring. Then, as an esterification catalyst, 0.52 parts of tin di(2-ethylhexanoate) was added with respect to 100.00 parts of the monomers, the temperature was raised to 200° C., and condensation polymerization was continued until a desired molecular weight was obtained.

Then, 3.00 parts of trimellitic anhydride was added with respect to 100.00 parts of the monomers to obtain a polyester resin 1.

The weight average molecular weight (Mw) of the obtained polyester resin 1 was 20,000, the glass transition temperature (Tg) was 75° C., and the acid value was 8.2 mg KOH/g.

Production Examples of Polyester Resins 2 to 8

Polyester resins 2 to 8 were obtained in the same manner as in the production example of the polyester resin 1 except that types and molar ratios of acid components and alcohol components were changed as shown in Table 2.

In the production examples of the polyester resins, the reaction temperature and the time were adjusted so that desired molecular weights were obtained.

TABLE 2

| | Composition | |
|---|---|---|
| | Acid components | Alcohol components |
| Polyester resin 1 | 1.00 mol of terephthalic acid | 0.65 mol of BPA-PO 2 mol adduct<br>0.35 mol of ethylene glycol |
| Polyester resin 2 | 0.90 mol of terephthalic acid<br>0.10 mol of adipic acid | 0.65 mol of BPA-PO 2 mol adduct<br>0.35 mol of ethylene glycol |
| Polyester resin 3 | 0.87 mol of terephthalic acid<br>0.13 mol of adipic acid | 0.65 mol of BPA-PO 2 mol adduct<br>0.35 mol of ethylene glycol |
| Polyester resin 4 | 1.00 mol of terephthalic acid | 0.65 mol of BPA-PO 2 mol adduct<br>0.15 mol of ethylene glycol<br>0.20 mol of isosorbide |
| Polyester resin 5 | 1.00 mol of terephthalic acid | 0.65 mol of BPA-PO 2 mol adduct<br>0.05 mol of ethylene glycol<br>0.30 mol of isosorbide |
| Polyester resin 6 | 1.00 mol of terephthalic acid | 0.60 mol of BPA-PO 2 mol adduct<br>0.30 mol of ethylene glycol |
| Polyester resin 7 | 1.00 mol of terephthalic acid | 0.65 mol of BPA-PO 2 mol adduct<br>0.30 mol of ethylene glycol |
| Polyester resin 8 | 1.00 mol of terephthalic acid | 1.00 mol of BPA-PO 2 mol adduct |

Here, in the table, the BPA-PO 2 mol adduct indicates a bisphenol A propylene oxide (2 mol) adduct.

The physical properties of the obtained polyester resins 1 to 8 are summarized in Table 3.

TABLE 3

| | Tg (° C.) | Mw | Acid value (mgKOH/g) |
|---|---|---|---|
| Polyester resin 1 | 75 | 20000 | 8.2 |
| Polyester resin 2 | 62 | 20000 | 8.0 |
| Polyester resin 3 | 58 | 20000 | 9.2 |
| Polyester resin 4 | 85 | 20000 | 8.5 |
| Polyester resin 5 | 92 | 20000 | 8.0 |
| Polyester resin 6 | 75 | 18000 | 24.2 |
| Polyester resin 7 | 75 | 19000 | 14.5 |
| Polyester resin 8 | 82 | 18000 | 7.8 |

Production Example of Fine Particle Dispersion of Polyester Resin 6

| | |
|---|---|
| Polyester resin 6: | 144 parts |
| Isopropyl acrylamide (commercially available from Kohjin Co., Ltd.): | 16 parts |
| Ethyl acetate: | 233 parts |
| Sodium hydroxide aqueous solution (0.3 mol/L): | 0.1 parts |

The above components were put into a 1,000 ml separable flask and heated to 70° C., and stirred to prepare a resin mixture solution. In the resin mixture solution, additionally, 373 parts of deionized water was gradually added thereto under stirring, to cause a phase inversion emulsification, the solvent was then removed, and thereby a fine particle dispersion (with a solid content concentration of 30 mass %) of the polyester resin 6 was obtained. The volume average particle diameter of resin particles in the dispersion was 110 nm.

Production Example of Fine Particle Dispersion of Polyester Resin 7

A fine particle dispersion (with a solid content concentration of 30 mass %) of the polyester resin 7 was obtained in the same manner as in the production example of the fine particle dispersion of the polyester resin 6 except that the polyester resin 7 was used in place of the polyester resin 6 in the production example of the fine particle dispersion of the polyester resin 6. The volume average particle diameter of the resin particles in the dispersion was 190 nm.

Production Example of Styrene Acrylic Resin Fine Particle Dispersion 1

| | |
|---|---|
| Styrene: | 375 parts |
| Dodecanethiol: | 3.0 parts |

A solution of 8.0 parts of an anionic surfactant Dowfax (commercially available from Dow Chemical Company) in 800 parts of deionized water was added to the above components that were mixed and dissolved, and the mixture was dispersed and emulsified in a flask. While slowly mixing and stirring the resultant mixture for 10 minutes, 50 parts of deionized water in which 6.0 parts of ammonium persulfate was dissolved was additionally put thereinto. Next, purging with nitrogen was performed in the flask, the solution in the flask was then heated under stirring until the temperature became 70° C. in an oil bath. Emulsion polymerization was further continued for 5 hours, and thereby a styrene acrylic resin fine particle dispersion 1 was obtained. The volume average particle diameter of particles in the styrene acrylic resin fine particle dispersion 1 was 90 nm, the solid content was 30 mass %, Tg was 100° C., and the weight average molecular weight Mw was 30,000.

Production Example of Styrene Acrylic Resin Fine Particle Dispersion 2

| | |
|---|---|
| Styrene: | 225 parts |
| n-Butyl acrylate: | 75 parts |
| 1,6-Hexanediol diacrylate: | 0.5 parts |
| Dodecanethiol: | 3.0 parts |

A solution of 8.0 parts of an anionic surfactant Dowfax (commercially available from Dow Chemical Company) in 800 parts of deionized water was added to the above components that were mixed and dissolved, and the mixture was dispersed and emulsified in a flask. While slowly mixing and stirring for 10 minutes, 50 parts of deionized water in which 4.0 parts of ammonium persulfate was dissolved was additionally put thereinto. Next, purging with nitrogen was performed in the flask, the solution in the flask was then heated under stirring until the temperature became 65° C. in an oil bath. Emulsion polymerization was further continued for 5 hours, and thereby a styrene acrylic resin fine particle dispersion 2 was obtained. The volume average particle diameter of particles in the styrene acrylic resin fine particle dispersion 2 was 80 nm, the solid content was 30 mass %, Tg was 54° C., and the weight average molecular weight Mw was 30,000.

Production Example of Crystalline Polyester

A reaction container including a stirrer, a thermometer, a nitrogen inlet tube, a dehydration tube, and a pressure reducing device was charged with 1.0 mol of sebacic acid and 1.0 mol of 1,6-hexanediol, and heating was performed to a temperature of 130° C. under stirring. 0.7 parts of titanium (IV) isopropoxide as an esterification catalyst was added with respect to 100.0 parts of the monomers, and then the temperature was raised to 180° C. and a reaction was continued until a desired molecular weight was obtained while depressurizing, and thereby a crystalline polyester was obtained. The weight average molecular weight (Mw) of the crystalline polyester was 15,000, and the melting point (Tm) was 68.1° C.

The production examples of the toners are shown below. Toners 1 to 17 were produced as examples and Toners 18 to 24 were produced as comparative examples.

Production Example of Toner 1

| | |
|---|---|
| Styrene | 60.0 parts |
| Colorant | 6.0 parts |

(C.I. Pigment Blue 15:3, commercially available from Dainichiseika Co., Ltd.)

The above materials were put into an attritor (commercially available from Mitsui Miike Machinery Co., Ltd.), and additionally, using zirconia particles with a diameter of 1.7 mm, the materials were dispersed at 220 rpm for 5 hours, and thereby a pigment dispersion was obtained.

| | |
|---|---|
| Styrene | 15.0 parts |
| n-Butyl acrylate | 25.0 parts |
| Polyester resin 1 | 8.0 parts |
| Wax 1 | 15.0 parts |
| Hydrocarbon wax HNP-9 (commercially available from Nippon Seiro Co., Ltd., melting point 74° C.) | 3.0 parts |
| Divinylbenzene | 0.5 parts |

The above materials were mixed and added to a pigment dispersion. The obtained mixture was kept at 60° C., and stirred at 500 rpm using a T. K. Homo Mixer (commercially available from Tokushu Kika Kogyo Co., Ltd.), and uniformly dissolved and dispersed to prepare a polymerizable monomer composition.

Meanwhile, in a container including a high speed stirring device Clearmix (commercially available from M Technique Co., Ltd.), 850.0 parts of a 0.10 mol/L-$Na_3PO_4$ aqueous solution and 8.0 parts of 10% hydrochloric acid were added and the rotational speed was adjusted to 15,000 rpm, and heating was performed at 70° C. Here, 68.0 parts of a 1.0 mol/L-$CaCl_2$ aqueous solution was added to prepare an aqueous medium containing a calcium phosphate compound.

The polymerizable monomer composition was put into the aqueous medium, and 7.0 parts of t-butyl peroxy pivalate as a polymerization initiator was then added thereto and granulation was performed for 10 minutes while maintaining a rotational speed of 15,000 rpm. Then, a high-speed stirrer was replaced with a propeller stirring blade, a reaction was continued at 70° C. for 5 hours while refluxing, and the liquid temperature was then set to 85° C., and additionally a reaction was further continued for 2 hours.

After the polymerization reaction was completed, the obtained slurry was cooled and hydrochloric acid was then added to the slurry to set a pH to 1.4. Stirring was continued for 1 hour, and thus calcium phosphate was dissolved therein. Then, washing was performed with an amount of water that was three times the amount of the slurry, then the washed fluid was filtered and dried and the obtained solid matter was classified, to obtain toner particles.

Then, with respect to 100.0 parts of toner particles, 2.0 parts of silica fine particles (number average particle diameter of primary particles: 10 nm, BET specific surface area: 170 $m^2/g$) hydrophobized with dimethyl silicone oil (20 mass %) was added as an external additive, and was mixed using a Mitsui Henschel Mixer (commercially available from Mitsui Miike Machinery Co., Ltd.), at 3,000 rpm for 15 minutes to obtain Toner 1.

Production Examples of Toners 2 to 7, 10 to 15, 18 to 23, 25, and 26

As shown in Table 4, Toners 2 to 7, 10 to 15, 18 to 23, 25, and 26 were obtained in the same manner as in the production example of Toner 1 except that types of waxes or crystalline polyesters and amounts added thereof, types and amounts of polyester resins, and amounts of divinylbenzene were changed.

However, in production of Toners 7 and 25, the polyester resin 1 was not added, and 1.0 part of an aluminum salicylate compound (Bontron E-88: commercially available from Orient Chemical Industries Co., Ltd.) was added.

TABLE 4

| | Wax | | Polyester resin | | Divinylbenzene |
|---|---|---|---|---|---|
| | Type | Parts | Type | Parts | Parts |
| Toner 1 | Wax 1 | 15.0 | Polyester resin 1 | 8.0 | 0.5 |
| Toner 2 | Wax 1 | 12.0 | Polyester resin 1 | 8.0 | 0.5 |
| Toner 3 | Wax 1 | 9.0 | Polyester resin 1 | 8.0 | 0.5 |
| Toner 4 | Wax 1 | 15.0 | Polyester resin 1 | 5.0 | 0.5 |
| Toner 5 | Wax 2 | 15.0 | Polyester resin 1 | 8.0 | 0.5 |
| Toner 6 | Wax 3 | 15.0 | Polyester resin 1 | 8.0 | 0.5 |
| Toner 7 | Wax 1 | 15.0 | — | — | 1.0 |
| Toner 8 | Production example is described in the text of the description | | | | |
| Toner 9 | Production example is described in the text of the description | | | | |
| Toner 10 | Wax 1 | 15.0 | Polyester resin 2 | 8.0 | 0.5 |
| Toner 11 | Wax 1 | 15.0 | Polyester resin 3 | 8.0 | 0.5 |
| Toner 12 | Wax 1 | 15.0 | Polyester resin 4 | 8.0 | 0.5 |
| Toner 13 | Wax 1 | 15.0 | Polyester resin 5 | 8.0 | 0.5 |
| Toner 14 | Wax 4 | 15.0 | Polyester resin 1 | 8.0 | 0.5 |
| Toner 15 | Wax 5 | 15.0 | Polyester resin 1 | 8.0 | 0.5 |
| Toner 16 | Production example is described in the text of the description | | | | |
| Toner 17 | Production example is described in the text of the description | | | | |
| Toner 18 | Wax 1 | 7.0 | Polyester resin 1 | 8.0 | 0.5 |
| Toner 19 | Wax 6 | 15.0 | Polyester resin 1 | 8.0 | 0.5 |
| Toner 20 | Crystalline polyester | 15.0 | Polyester resin 1 | 8.0 | 0.5 |
| Toner 21 | Wax 7 | 15.0 | Polyester resin 1 | 8.0 | 0.5 |
| Toner 22 | Wax 3 | 15.0 | Polyester resin 1 | 8.0 | 0 |
| Toner 23 | Wax 1 | 15.0 | — | — | 0.5 |
| Toner 24 | Production example is described in the text of the description | | | | |
| Toner 25 | Wax 1 | 15.0 | Polyester resin 1 | 8.0 | 2.0 |
| Toner 26 | Wax 1 | 15.0 | Polyester resin 8 | 8.0 | 0.5 |

Production Example of Toner 8

A slurry of toner particles was produced in the same manner as in the production example of Toner 1.

Under stirring, a fine particle dispersion of the polyester resin 6 (5.0 parts of solid content of the polyester resin 6 with respect to 100 parts of toner particles solid content) was added to the slurry of the toner particles, stirring continued for 30 minutes and heating was then performed to a temperature of 55° C.

Next, a hydrochloric acid aqueous solution (0.2 mol/liter) was added dropwise so that a pH of the slurry decreased by 0.1 per minute and a pH of the slurry was made to 1.5. While maintaining the temperature, stirring was further continued for 2 hours, and under stirring, the sodium hydroxide aqueous solution (1 mol/liter) was then added dropwise at a dripping speed of 10.0 parts/min so that a pH of the slurry was 7.2.

The slurry was heated to 70° C. and further stirred for 2 hours. The slurry was cooled to 20° C., hydrochloric acid was then added to the slurry to set a pH to 1.4, stirring was continued for 1 hour, and thus calcium phosphate was dissolved therein. Then, washing was performed with an amount of water that was three times the amount of the slurry, then the washed fluid was filtered and dried and the obtained solid matter was classified, to obtain toner particles.

Then, with respect to 100.0 parts of the toner particles, 2.0 parts of silica fine particles (number average particle diameter of primary particles: 10 nm, BET specific surface area: 170 $m^2/g$) hydrophobized with dimethyl silicone oil (20 mass %) was added as an external additive and was mixed using a Mitsui Henschel Mixer (commercially available from Mitsui Miike Machinery Co., Ltd.), at 3,000 rpm for 15 minutes to obtain Toner 8.

Production Example of Toner 9

Toner 9 was obtained in the same manner as in the production example of Toner 8 except that the fine particle dispersion of the polyester resin 7 was used in place of the fine particle dispersion of the polyester resin 6, and an amount of the fine particle dispersion of the polyester resin 7 added was changed to 8.0 parts of solid content of the polyester resin 7 with respect to 100 parts of the toner particles solid content.

Production Example of Toner 17

Resin fine particles were added/attached and externally added to the slurry of the toner particles obtained in the production example of Toner 23 in the same manner as in the production example of Toner 8, and thereby Toner 17 was obtained. However, a styrene acrylic resin fine particle dispersion 1 was used in place of the fine particle dispersion of the polyester resin 6, and an amount of the styrene acrylic resin fine particle dispersion 1 added was changed to 10.0 parts of solid content of the styrene acrylic resin with respect to 100 parts of the toner particle solid content.

Production Example of Toner 24

A slurry of toner particles was produced in the same manner as in the production example of Toner 23.

To the obtained toner slurry, 1.5 parts of methyl methacrylate and 0.15 parts of 2,2'-azobis(2-methyl-N-(2-hydroxyethyl)-propionamide) (product name "VA-086" commercially available from Wako Pure Chemical Industries, Ltd.), which was dissolved in 20 parts of deionized water were added. Then, heating was further continued at 90° C. for 3 hours, and polymerization was continued. The slurry was cooled to 20° C., hydrochloric acid was then added to the slurry to set a pH to 1.4, stirring was continued for 1 hour, and thus calcium phosphate was dissolved therein. Then, washing was performed with an amount of water that was three times the amount of the slurry, then the washed fluid was filtered and dried and the obtained solid matter was classified, to obtain toner particles.

Then, with respect to 100.0 parts of the toner particles 2.0 parts of a silica fine particles (number average particle diameter of primary particles: 10 nm, BET specific surface area: 170 $m^2/g$) hydrophobized with dimethyl silicone oil (20 mass %) was added as an external additive, and was mixed using a Mitsui Henschel Mixer (commercially available from Mitsui Miike Machinery Co., Ltd.), at 3,000 rpm for 15 minutes to obtain Toner 24.

<Preparation of Wax Dispersion>

| | |
|---|---|
| Wax 1: | 180 parts |
| Anionic surfactant (Neogen R, commercially available from DKS Co., Ltd.): | 4.5 parts |
| Deionized water: | 410 parts |

The above components were heated to 110° C. and dispersed using a homogenizer (commercially available from IKA: Ultra Turrax T50) and were then dispersed using a Manton-Gaulin high pressure homogenizer (commercially available from Gaulin), wax particles with a volume average particle diameter of 0.20 μm was dispersed, the concentration was adjusted using deionized water, and thereby a wax dispersion having a solid content concentration of the wax particles of 30.0 mass % was prepared.

<Preparation of Colorant Dispersion>

| | |
|---|---|
| C.I. Pigment Blue 15:3 (commercially available from Dainichiseika Co., Ltd.): | 250 parts |
| Anionic surfactant (Neogen SC commercially available from DKS Co., Ltd.): | 33 parts (active component of 60%, 8% with respect to the colorant) |
| Deionized water: | 280 parts |

The above components were put into a stainless steel container and stirred using a stirrer until there was no unwet pigment, and sufficiently defoamed. After defoaming, 470 parts of the remaining deionized water was added, and dispersed at 5,000 rpm for 10 minutes using a homogenizer (Ultra Turrax T50 commercially available from IKA), and stirring was then continued for an entire day and night using a stirrer and the mixture was defoamed.

Subsequently, the dispersion was dispersed at a pressure of 240 MPa using a high-pressure impact type dispersing machine Altimizer (HJP30006 commercially available from Sugino Machine Ltd.). The obtained dispersion was left for 24 hours to remove precipitates, and deionized water was added so that the solid content concentration was adjusted to 20 mass %. The volume average particle diameter of particles in the colorant dispersion was 135 nm.

Production Example of Toner 16

| | |
|---|---|
| Deionized water: | 315 parts |
| Styrene acrylic resin fine particle dispersion 2: | 333 parts (a solid content: 30 mass %) |
| Colorant dispersion: | 29 parts (a solid content: 20 mass %) |
| Wax dispersion: | 50 parts (a solid content: 30 mass %) |
| Anionic surfactant (Neogen RK, 20% commercially available from DKS Co., Ltd.): | 3.8 parts |

The above components were put into a 3 L reaction container including a thermometer, a pH meter, and a stirrer and left at a temperature of 30° C. and a stirring rotational speed of 150 rpm for 30 minutes while the temperature was controlled using a mantle heater from the outside. Then, a nitric acid aqueous solution (0.3 mol/L) was added, and a pH was adjusted to 3.0 in the aggregation process.

While dispersing using a homogenizer (Ultra Turrax T50 commercially available from IKA Japan), a polyaluminum chloride aqueous solution of 1.0 part of polyaluminum chloride (commercially available from OJI Paper Co., Ltd.: 30% powder product) in 10 parts of deionized water was added. Then, under stirring, the temperature was raised to 50° C., a particle diameter was measured using a Coulter Multisizer II (aperture diameter: 50 commercially available from Coulter Inc.), and the volume average particle diameter was made to 5.6 Then, 40 parts (with a solid content of 30 mass %) of the fine particle dispersion of the polyester resin 6 was additionally added and stirring was performed for 30 minutes.

Subsequently, 30 parts of 10% NTA (nitrilotriacetic acid) metal salt aqueous solution (Chelest 70: commercially available from Chelest Corporation) was added and a pH was then set to 9.0 using a sodium hydroxide aqueous solution (1 mol/L). Then, heating was performed to 90° C., and the mixture was left at 90° C. for 3 hours, and then cooled to 30° C. The mixture was further dispersed again in deionized water and repeatedly filtered, and washing was performed until the electrical conductivity of the filtrate became 20 μS/cm or less, and vacuum drying was then performed in an oven at 40° C. for 5 hours to obtain toner particles.

Then, with respect to 100.0 parts of the toner particles 2.0 parts of a silica fine particles (number average particle diameter of primary particles: 10 nm, BET specific surface area: 170 $m^2/g$) hydrophobized with dimethyl silicone oil (20 mass %) was added as an external additive, and mixed using a Mitsui Henschel Mixer (commercially available from Mitsui Miike Machinery Co., Ltd.), at 3,000 rpm for 15 minutes to obtain Toner 16.

Physical properties of the obtained Toners 1 to 26 were measured according to the above methods. The results are summarized in Table 5.

TABLE 5

| | | Elastic modulus physical properties | | | | Physical properties of coat layer | | | Physical properties of toners | | | |
|---|---|---|---|---|---|---|---|---|---|---|---|---|
| | | T (1 Hz) ° C. | T (20 Hz) ° C. | T (20 Hz) − T (1 Hz) ° C. | tanδ(P) | Thickness nm | Material | Tg ° C. | Tg ° C. | Mw | D4 μm | Wax content Mass % |
| Example 1 | Toner 1 | 67.3 | 70.0 | 2.7 | 1.43 | 30 | Polyester | 75 | 52 | 80000 | 6.5 | 10.5 |
| Example 2 | Toner 2 | 67.5 | 72.0 | 4.5 | 1.43 | 30 | Polyester | 75 | 52 | 80000 | 6.5 | 8.2 |
| Example 3 | Toner 3 | 67.8 | 74.8 | 7.0 | 1.41 | 30 | Polyester | 75 | 52 | 80000 | 6.5 | 6.0 |
| Example 4 | Toner 4 | 67.1 | 70.0 | 2.9 | 1.70 | 15 | Polyester | 75 | 52 | 80000 | 7.2 | 10.5 |
| Example 5 | Toner 5 | 61.3 | 63.6 | 2.3 | 1.43 | 30 | Polyester | 75 | 52 | 80000 | 6.5 | 10.5 |
| Example 6 | Toner 6 | 74.8 | 79.2 | 4.4 | 1.43 | 30 | Polyester | 75 | 52 | 80000 | 6.5 | 10.5 |
| Example 7 | Toner 7 | 67.3 | 72.3 | 5.0 | 0.80 | — | — | — | 54 | 120000 | 8.2 | 10.5 |
| Example 8 | Toner 8 | 67.3 | 70.0 | 2.7 | 1.10 | 100 | Polyester | 75 | 52 | 80000 | 6.8 | 10.1 |
| Example 9 | Toner 9 | 67.3 | 70.0 | 2.7 | 0.90 | 200 | Polyester | 75 | 52 | 80000 | 7.2 | 9.9 |
| Example 10 | Toner 10 | 67.3 | 69.8 | 2.5 | 1.68 | 30 | Polyester | 62 | 52 | 80000 | 6.5 | 10.5 |
| Example 11 | Toner 11 | 67.3 | 70.1 | 2.8 | 1.85 | 30 | Polyester | 58 | 52 | 80000 | 6.5 | 10.5 |
| Example 12 | Toner 12 | 67.3 | 70.0 | 2.7 | 1.20 | 30 | Polyester | 85 | 52 | 80000 | 6.5 | 10.5 |
| Example 13 | Toner 13 | 67.3 | 70.0 | 2.7 | 1.10 | 30 | Polyester | 92 | 52 | 80000 | 6.5 | 10.5 |
| Example 14 | Toner 14 | 60.1 | 64.3 | 4.2 | 1.43 | 30 | Polyester | 75 | 52 | 80000 | 6.5 | 10.5 |
| Example 15 | Toner 15 | 73.0 | 79.8 | 6.8 | 1.43 | 30 | Polyester | 75 | 52 | 80000 | 6.5 | 10.5 |
| Example 16 | Toner 16 | 66.6 | 70.0 | 3.4 | 1.25 | 100 | Polyester | 75 | 54 | 30000 | 5.8 | 9.5 |
| Example 17 | Toner 17 | 67.3 | 70.0 | 2.7 | 1.82 | 100 | Polystyrene | 100 | 52 | 80000 | 8.6 | 9.1 |
| Comparative Example 1 | Toner 18 | 67.7 | 75.9 | 8.2 | 1.45 | 30 | Polyester | 75 | 52 | 80000 | 6.5 | 5.0 |
| Comparative Example 2 | Toner 19 | 71.5 | 82.3 | 10.8 | 1.30 | 30 | Polyester | 75 | 52 | 80000 | 6.5 | 10.5 |
| Comparative Example 3 | Toner 20 | 65.0 | 77.6 | 12.6 | 1.35 | 30 | Polyester | 75 | 49 | 80000 | 7.5 | 9.5 |
| Comparative Example 4 | Toner 21 | 57.8 | 62.0 | 4.2 | 1.43 | 30 | Polyester | 75 | 52 | 80000 | 6.5 | 10.0 |
| Comparative Example 5 | Toner 22 | 74.8 | 79.2 | 4.4 | 1.95 | 30 | Polyester | 75 | 52 | 30000 | 6.5 | 10.5 |
| Comparative Example 6 | Toner 23 | 67.1 | 70.0 | 2.9 | 2.10 | — | — | — | 53 | 70000 | 8.2 | 10.5 |
| Comparative Example 7 | Toner 24 | 67.1 | 70.0 | 2.9 | 2.00 | 20 | PMMA | 105 | 53 | 70000 | 8.2 | 10.2 |
| Comparative Example 8 | Toner 25 | 70.1 | 74.1 | 4.0 | 0.70 | 30 | Polyester | 75 | 54 | 200000 | 6.5 | 10.5 |
| Example 18 | Toner 26 | 67.3 | 70.0 | 2.7 | 1.90 | 30 | Polyester | 82 | 52 | 80000 | 6.9 | 10.5 |

In the table, PMMA indicates polymethyl methacrylate.

Performances of the obtained Toners 1 to 26 were evaluated according to the following methods. The results are shown in Table 6.

[Low-Temperature Fixability]

Regarding evaluation of low-temperature fixability, a lowest fixation temperature at which no visible image defects occurred in the fixed image was evaluated.

Here, examples of visible image defects occurring during fixing at a low temperature mainly included a cold offset occurring due to toner that did not melt.

Evaluation was performed as follows.

A color laser printer (HP Color LaserJet 3525dn, commercially available from HP) from which a fixing unit was removed was prepared, the toner was removed from the cyan cartridge, and instead, it was filled with a toner to be evaluated.

Next, on image receiving paper (Office Planner commercially available from Canon Inc; 64 g/m$^2$), an unfixed toner image with a height of 2.0 cm and a width 15.0 cm (toner laid-on level: 0.9 mg/cm$^2$) was formed in a part at 1.0 cm from the upper end with respect to a paper passing direction using the filled toner.

Next, the removed fixing unit was remodeled so that the fixation temperature and the process speed could be adjusted, and a fixation test was performed on the unfixed image using this.

First, under a normal temperature and normal humidity environment (23° C., 60% RH), the process speed was set to 300 mm/s, the initial temperature was set to 150° C., and while the set temperature was sequentially raised by 5° C. to 230° C., the unfixed image was fixed at each temperature. Regarding the obtained fixed image, the fixation temperature at which no cold offset occurred was set as the lowest fixation temperature, and low-temperature fixability was evaluated according to the following criteria. When the result was D or higher, it was determined that the effects of the present invention were obtained.

A: lowest fixation temperature was 150° C.
B: lowest fixation temperature was 155° C.
C: lowest fixation temperature was 160° C.
D: lowest fixation temperature was 165° C.
E: lowest fixation temperature was 170° C.
F: lowest fixation temperature was 175° C. or higher

[Separability from Fixing Member]

Regarding separability from a fixing member, a fixation temperature range in which the paper could pass without being wound around the fixing member during fixing was evaluated.

In the above fixation test, separability from the fixing member was evaluated according to the following criteria.

The evaluation criteria are as follows. When the result was D or higher, it was determined that the effects of the present invention were obtained.

A: No winding on the fixing member occurred at the lowest fixation temperature of +45° C.
B: Winding on the fixing member occurred even at the lowest fixation temperature of +45° C., but no winding on the fixing member occurred at +40° C. or +35° C.

C: Winding on the fixing member occurred at the lowest fixation temperature of +35° C., but no winding on the fixing member occurred at +30° C. or +25° C.

D: Winding on the fixing member occurred at the lowest fixation temperature of +25° C., but no winding on the fixing member occurred at +20° C. or +15° C.

E: Winding on the fixing member occurred at the lowest fixation temperature of +15° C., but no winding on the fixing member occurred at +10° C. or +5° C.

F: The temperature at which no winding on the fixing member occurred was only the lowest fixation temperature or there was no temperature at which no winding on the fixing member occurred.

[Evaluation of Heat-Resistant Storability]

A resin cup (100 mL) containing 5.0 g of an evaluation toner sample was left under a high temperature environment (temperature of 50° C./relative humidity of 50%) for 3 days. Then, the cup was transferred to a normal temperature and normal humidity environment (temperature of 23° C./relative humidity of 50%) and left for 1 hour. A "Powder tester PT-X" (commercially available from Hosokawa Micron Corporation) was used as a measuring apparatus, and the amount of the remaining toner was measured using a sieve with openings of 75 μm under a normal temperature and normal humidity environment (temperature of 23° C./relative humidity of 50%). The amplitude of the sieve was adjusted to 1.00 mm (peak-to-peak), and the evaluation toner was placed on the sieve, and vibrated for 40 seconds. Then, heat-resistant storability was evaluated based on the amount of toner aggregates remaining on the sieve, and heat-resistant storability was evaluated according to the following evaluation criteria.

A: The amount of the remaining toner on the mesh was 0.10 g or less.

B: The amount of the remaining toner on the mesh was larger than 0.10 g and 0.20 g or less.

C: The amount of the remaining toner on the mesh was larger than 0.20 g and 0.30 g or less.

D: The amount of the remaining toner on the mesh was larger than 0.30 g and 0.40 g or less.

E: The amount of the remaining toner on the mesh was larger than 0.40 g and 0.50 g or less.

F: The amount of the remaining toner on the mesh was larger than 0.50 g.

TABLE 6

| | | Low-temperature fixability | | Separability from fixing member | | Heat-resistant storability | |
|---|---|---|---|---|---|---|---|
| | | Rank | (X) | Rank | (Y) | Rank | (Z) |
| Example 1 | Toner 1 | A | 150 | A | 230 | A | 0.08 |
| Example 2 | Toner 2 | B | 155 | A | 230 | A | 0.06 |
| Example 3 | Toner 3 | C | 160 | A | 230 | A | 0.05 |
| Example 4 | Toner 4 | A | 150 | B | 190 | A | 0.05 |
| Example 5 | Toner 5 | A | 150 | A | 200 | B | 0.17 |
| Example 6 | Toner 6 | B | 155 | A | 230 | A | 0.05 |
| Example 7 | Toner 7 | D | 165 | B | 200 | C | 0.25 |
| Example 8 | Toner 8 | B | 155 | A | 230 | A | 0.05 |
| Example 9 | Toner 9 | C | 160 | A | 230 | A | 0.09 |
| Example 10 | Toner 10 | A | 150 | B | 190 | A | 0.08 |
| Example 11 | Toner 11 | A | 150 | D | 170 | B | 0.19 |
| Example 12 | Toner 12 | B | 155 | A | 230 | A | 0.04 |
| Example 13 | Toner 13 | D | 165 | A | 230 | A | 0.05 |
| Example 14 | Toner 14 | B | 155 | A | 200 | C | 0.28 |
| Example 15 | Toner 15 | C | 160 | A | 210 | A | 0.09 |
| Example 16 | Toner 16 | B | 155 | A | 200 | B | 0.19 |
| Example 17 | Toner 17 | C | 160 | C | 185 | A | 0.09 |

TABLE 6-continued

| | | Low-temperature fixability | | Separability from fixing member | | Heat-resistant storability | |
|---|---|---|---|---|---|---|---|
| | | Rank | (X) | Rank | (Y) | Rank | (Z) |
| Comparative Example 1 | Toner 18 | E | 170 | A | 230 | A | 0.08 |
| Comparative Example 2 | Toner 19 | F | 180 | A | 230 | A | 0.05 |
| Comparative Example 3 | Toner 20 | F | 180 | A | 230 | C | 0.21 |
| Comparative Example 4 | Toner 21 | B | 155 | A | 200 | E | 0.45 |
| Comparative Example 5 | Toner 22 | | | (F) | | A | 0.09 |
| Comparative Example 6 | Toner 23 | A | 150 | F | 150 | C | 0.28 |
| Comparative Example 7 | Toner 24 | E | 170 | E | 180 | B | 0.18 |
| Comparative Example 8 | Toner 25 | E | 170 | A | 230 | A | 0.09 |
| Example 18 | Toner 26 | C | 160 | C | 185 | A | 0.07 |

(X): Lowest fixation temperature (° C.)
(Y): Highest temperature at which fixation could be performed without being wound (° C.)
(Z): Amount of remaining toner on mesh (g)
(F): Evaluation was not possible due to the occurrence of hot offset at all temperatures.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-146131, filed Aug. 2, 2018, and Japanese Patent Application No. 2019-031467, filed Feb. 25, 2019, which are hereby incorporated by reference herein in their entirety.

What is claimed is:

1. A toner, comprising:

a toner particle that contains a binder resin and a wax;

the binder resin including an amorphous resin A having a styrene acrylic polymer segment, a content of resin A in the binder resin being at least 50 mass %;

the wax containing an ester compound selected from the group consisting of an ethylene glycol distearate, an ethylene glycol dipalmitate and an ethylene glycol dibehenate; and the toner particle having a coat layer on the surface thereof, the coat layer including an amorphous resin B, resin B including a polyester resin and having a glass transition temperature of 60 to 90° C., wherein $$T(20\text{ Hz})-T(1\text{ Hz})\leq 7.0^\circ\text{ C.}$$

$$0.80\leq \tan\delta(P)\leq 1.90$$

$$60^\circ\text{ C.}\leq T(1\text{ Hz})\leq 80^\circ\text{ C.}$$

$$60^\circ\text{ C.}\leq T(20\text{ Hz})\leq 80^\circ\text{ C.}$$

when in dynamic viscoelasticity measurement of the toner, T(1 Hz) is the temperature at which the loss elastic modulus G" measured at a frequency of 1 Hz becomes $1.00\times10^6$ Pa and T(20 Hz) is the temperature at which the loss elastic modulus G" measured at a frequency of 20 Hz becomes $1.00\times10^6$ Pa, and tan δ(P) is a maximum value of the ratio (tan δ) of the loss elastic modulus G" with respect to the storage elastic modulus G', measured at a frequency of 20 Hz, in a range of 60 to 90° C.

2. The toner according to claim 1, wherein the thickness of the coat layer is 10 to 200 nm.

3. The toner according to claim 1, wherein the polyester resin has at least one of a structure represented by —O—$CH_2$—$CH_2$—O—and a structure represented by —C(═O)—C(═O)—.

4. The toner according to claim 1, wherein the polyester resin has a structure represented by Formula (A)

(A)

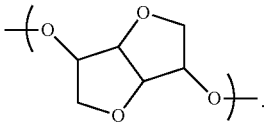

.

5. The toner according to claim 1, wherein a content of the wax in the toner is 5.0 to 20.0 mass %.

* * * * *